United States Patent [19]

Lacour et al.

[11] Patent Number: 4,578,656

[45] Date of Patent: Mar. 25, 1986

[54] MICROWAVE MICROSTRIP FILTER WITH U-SHAPED LINEAR RESONATORS HAVING CENTRALLY LOCATED CAPACITORS COUPLED TO GROUND

[75] Inventors: Clément-Francois Lacour, Paris; Patrick Janer, Neuilly sur Seine, both of France

[73] Assignee: Thomson-CSF, Paris, France

[21] Appl. No.: 568,432

[22] Filed: Jan. 5, 1984

[30] Foreign Application Priority Data

Jan. 31, 1983 [FR] France ..... 83 01454

[51] Int. Cl.[4] ..... H01P 1/203

[52] U.S. Cl. ..... 333/204; 333/205

[58] Field of Search ..... 333/204, 205, 203, 202, 333/246, 238, 175, 176, 177, 185, 167, 168, 161, 219, 220, 221, 235; 331/107 SL, 117 D

[56] References Cited

U.S. PATENT DOCUMENTS

| | | | |
|---|---|---|---|
| 3,530,411 | 9/1970 | Sear | 174/68.5 X |
| 3,621,367 | 11/1971 | Rosen et al. | 333/204 X |
| 3,745,489 | 7/1973 | Criscoe et al. | 333/185 |
| 4,262,269 | 4/1981 | Griffin et al. | 333/204 |
| 4,418,324 | 11/1983 | Higgins | 333/204 |

FOREIGN PATENT DOCUMENTS

| | | | |
|---|---|---|---|
| 1422803 | 1/1976 | United Kingdom | 333/204 |

OTHER PUBLICATIONS

Gysel, V. H., "Improved Hairpin-Line Filter" 1973 *IEEE G-MTT International Microwave Symposium;* Boulder, Colorado Jun. 4–6, 1973, pp. 205–207.

Wong, J. S., "Microstrip Tapped-Line Filter Design"; *IEEE Transactions on Microwave Theory & Technique;* MTT 27, No. 1, Jan. 1979, pp. 44–50.

*Primary Examiner*—Eugene R. LaRoche
*Assistant Examiner*—Benny T. Lee
*Attorney, Agent, or Firm*—Cushman Darby and Cushman

[57] ABSTRACT

A microwave filter comprising linear resonators makes use of proximity-coupled conductors situated on the first surface of a substrate of dielectric material, whose second surface parallel to the first surface is metallized to form a ground plane, in order to form the resonators. The extremities of each conductor are connected to the earth plane and the center of each conductor is equally connected to the earth plane via at least one capacitor.

9 Claims, 6 Drawing Figures

MICROWAVE MICROSTRIP FILTER WITH U-SHAPED LINEAR RESONATORS HAVING CENTRALLY LOCATED CAPACITORS COUPLED TO GROUND

BACKGROUND OF THE INVENTION

The present invention relates to microwave filters of small size, comprising linear resonators formed by one or more conductors.

It is known that band-pass or band cut-off microwave filters may be produced with resonators formed by U-shaped conductors deposited by metallization or any other equivalent means on a first plane surface of a substrate whose second surface, parallel to the first surface, is metallized in order to form a ground plane.

According to this arrangement, the branches of the U-shapes forming the resonators are mutually parallel and are dimensioned so that the total developed length of each of the U-shaped elements is equal to half the tuned wavelength $\lambda$ of the resonator.

The coupling factor between two resonators depends on the width of the conductor forming the resonator, on the distance which separates the branches of two adjacent U-shaped elements, as well as on the space existing between the two branches of one and the same U element.

The principal shortcomings of these filters are that they have parasitic responses at the multiple frequencies of their central operating frequency, in particular if they are situated within a closed casing, and that they have an appreciable bulk, mainly at frequencies lower than 8 GHz.

In order to overcome these disadvantages, it is commonly attempted to reduce the dimensions of the casings by reducing the dimensions of the resonators. For example, one solution consists in placing a capacitor between the free extremities of the branches of the U-shaped element of each resonator in order to tune the same to its operating frequency. This embodiment equally has as the advantage that it makes it possible to obtain filters having a satisfactory rejection of the parasitic frequencies. However, it has the disadvantage of giving rise to substantial electrical fields at the level of the capacitors and parasitic couplings between non-adjacent resonators which impair the response of the filter. Because of this, the physical behavior of a filter produced in this manner never corresponds to that of the filter to be expected theoretically, but to an approximation which on the one hand requires several long and careful tests for its production, and on the other hand, as a corollary, increases the cost price.

SUMMARY OF THE INVENTION

The object of the invention is to overcome the aforesaid disadvantages.

To this end, the invention provides a microwave filter incorporating linear resonators, comprising at least one conductor situated on the first plane surface of a substrate of dielectric material whose second surface parallel to the first surface is metallized so as to form a ground plane, the extremities of each conductor being connected to the ground plane, the length of each conductor being smaller than half the wavelength of the resonance frequency wave $F_o$ of the resonator which it forms, the centre of each conductor also being connected to the earth plane via at least one capacitor in order to tune each resonator to its resonance frequency $F_o$.

This arrangement has the advantage that it renders each resonator tunable to the desirable frequency $F_o$ whilst suppressing parasitic resonances at higher multiple frequencies of $F_o$.

It also has an advantage that the radiation of each resonator is reduced to a substantial degree, since the extremities of the conductors are connected to the ground plane. Equally, the radiation of the tuning capacitor of each resonator is attenuated considerably by the connection of one terminal of the capacitor to the ground plane.

This absence of parasitic radiation, which was difficult to measure in the prior art constructions of filters, facilitates the physical construction of the filters. On the other hand, as will appear on the following description, the equivalent diagram for each filter is greatly simplified which facilitates the theoretical response of these filters.

BRIEF DESCRIPTION OF THE DRAWINGS

Other features and advantages of the invention will appear from the following description in conjunction with the accompanying drawings, given solely by way of example, and in which.

DESCRIPTION OF THE PREFERRED EMBODIMENT

Figure 1:
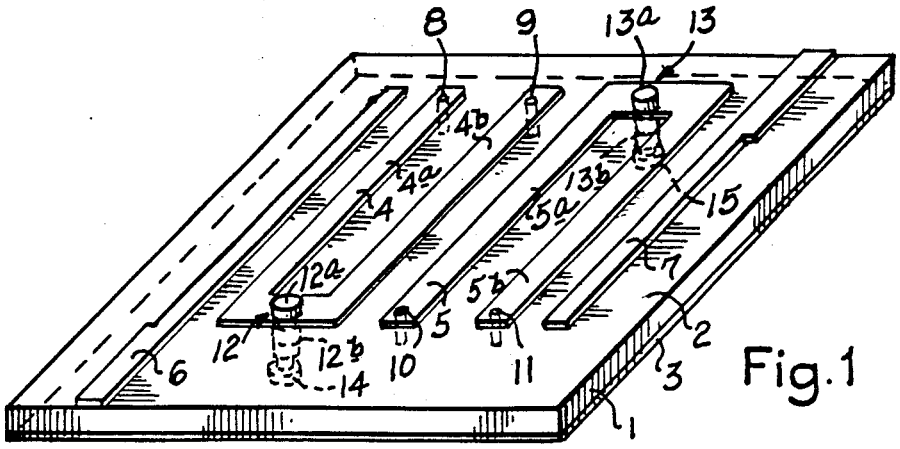
FIG. 1 is a perspective view of one embodiment of a microwave filter in accordance with the invention.

In the embodiment of the invention illustrated in FIG. 1, the filter comprises a substrate 1 having two mutually parallel plane rectangular surfaces 2 and 3 spaced apart by a few tenths of a millimeter to act as a support for two U-shaped conductors 4 and 5 and for two coupling conductors 6,7 directed approximately parallel. The substrate 1 is produced from a high-permittivity material of the type—magnesium titanate, alumina or teflon glass. The conductors 4,5,6 and 7 are deposited, for example, by metallization of strips on the first surface 2 of the substrate. The second surface 3 of the substrate is entirely covered by a metal layer also deposited by metallization or any other equivalent means.

The conductors 4 and 5 form, with the metal layer covering the surface 3 of the substrate, two resonators which, in the example, are fed by means of the coupling conductor 6 carrying the microwave signal fed to the input of the filter. The filtered signal is supplied by these resonators to an element external to the filter (not illustrated) by means of the coupling conductor 7.

The U-shaped elements formed by the conductors 4 and 5 have their positions reversed with respect to each other and their branches 4*a*,4*b* and 5*a*,5*b* are directed approximately parallel to the direction of the coupling conductors 6 and 7. The adjacent branches 4*b* and 5*a* of each resonator are slightly spaced apart from each other, in order to permit their being coupled electromagnetically. Similarly, the branches 4*a* and 5*b* are slightly spaced apart from the coupling conductors 6 and 7 to permit coupling of the conductors 6 and 7 with each of the resonators. The extremities of each of the U-shaped conductors 4 and 5 are connected to the ground plane covering the surface 3 of the substrate 1, through metallized holes 8,9,10 and 11. Two capacitors 12 and 13, are respectively situated between the centre of the conductors 4 and 5 and the earth plane, within holes formed in the thickness of the substrate 1. The plates 12*a* and 13*a* of the capacitors 12 and 13 are soldered respectively to the centre of the conductors 4 and 5 and the plates 12*b* and 13*b* of the capacitors 12 and 13 are soldered to the ground plane situated on the surface 3 of the substrate. In FIG. 1, the spaces between the capacitor electrodes, are adjustable by means of plunger cores 14 and 15 respectively, displaceable within plate members 12*b* and 13*b*.

Figure 2:
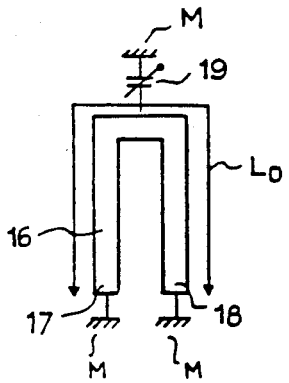
FIG. 2 is a circuit diagram of a filter resonator in accordance with the invention.

The diagram of a resonator applicable for the construction of the filters in accordance with the invention, is illustrated in simplified form in FIG. 2. The resonator of FIG. 2 is formed in a similar manner to that of FIG. 1, by a conductor 16 folded in the shape of a U, of which the extremities 17 and 18 are connected to the filter ground, and of which the centre is also connected to earth via a variable capacitor 19. The length $L_o$ of the conductor 16 is chosen to be smaller than the resonance wavelength in order to permit tuning the resonator by means of the capacitor 19.

A resonator of this nature simultaneously provides excellent control and excellent rejection of parasitic frequencies.

In fact, in the case in which the length $L_o$ is approximately equal to but smaller than the half wavelength $\lambda$ corresponding to the central resonance frequency $F_o$ of the resonator, the value of the capacitor 19 is set to a value close to zero. In this case, the parasitic responses at frequencies which are multiples of $2F_o$ are suppressed since the branches of the resonator establish a short-circuit across the terminals of the capacitor 19. By contrast, in the case in which the length $L_o$ has a much smaller value than the half wavelength $\lambda$, the value of the capacitor 19 should be set at a value which is not negligible in order to obtain resonance of the resonator and the rejection of interference parasitic radiation which, in this case, are multiples of $$\frac{2\pi}{\theta_o}$$

$F_o$, in which $\theta_o$ represents the electric angle corresponding to the line half-section having a length equal to $$\frac{L_o}{2}.$$

Figure 3:
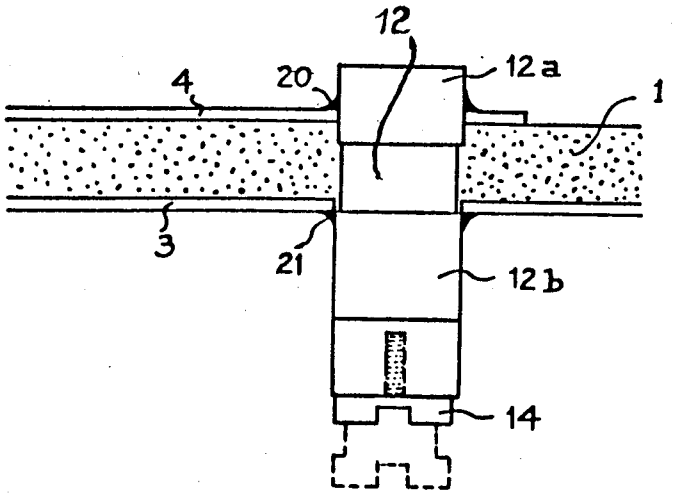
FIG. 3 is an illustration of the method of assembling a capacitor on the substrate of the filter.

Because capacitor 19 is connected to ground via one of its extremities, the radiation it emits is considerably reduced. The connections of a capacitor to the circuits of a resonator are shown in FIG. 3 which illustrates the capacitor 12 of FIG. 1 mounted on the substrate 1. In FIG. 3, each plate 12*a* and 12*b* of the capacitor is connected, respectively, to the conductor 4 and to the ground plane 3 covering the substrate 1 by means of solder fillets 40 and 41.

Figure 4:
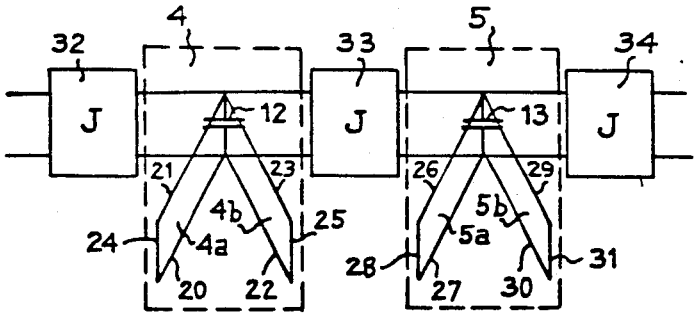
FIG. 4 is an illustration of the equivalent diagram of the filter illustrated in FIG. 1.

Since each resonator has both of its ends connected to ground, a radiating dipole is formed which emits less energy than an open-ended dipole of the prior art, so that the couplings between non-adjacent resonators are strongly attenuated. On the other hand, the structure of each resonator may be caused to revert to a simple equivalent diagram in the form of a dipole, which facilitates the determination of the filters by means of calculation. An example of an equivalent diagram is illustrated in FIG. 4. In this diagram, the resonator formed by the conductor 4*a* of FIG. 1 is equivalent to a line formed by the conductors 20,21 short-circuited at one extremity by a conductor 24 and connected at its other extremity to the terminals of the capacitor 12. Similarly, the conductor 4*b* is equivalent to a line formed by the conductors 22 and 23, short-circuited at one extremity by the conductor 25 and connected at its other extremity to the terminals of the capacitor 12. In identical manner, the conductors 5*a* and 5*b* formng the branches of the U-shaped element of the second resonator of FIG. 1 are equivalent to a line formed by the conductors 26,27, short-circuited at one extremity by the conductor 28 and connected at its other extremity to the terminals of the capacitor 13. Equally, the conductor 5*b* is equivalent to a line formed by the conductors 29 and 30, short-circuited at one extremity by the conductor 31 and connected at its other extremity to the terminals of the capacitor 13. In order to complete the equivalent diagram, the resonators 4 and 5 are coupled through impedance inverters 32,33 and 34.

Figure 5:
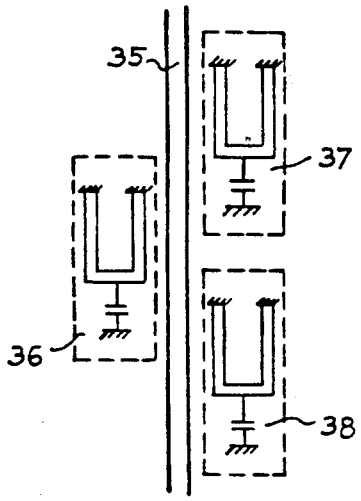
FIG. 5 is an illustration of a second embodiment of a microwave filter in accordance with the invention.

FIG. 5 illustrates an embodiment of a band cutoff filter produced by means of the U-shaped resonators in accordance with the invention, which has a single access line 35 of which the two extremities respectively form the input and output of the filter. Three resonators 36,37 and 38 are situated in the same plane as the line 35, with their branches parallel to the line 35 and are placed at either side of this line.

Figure 6:
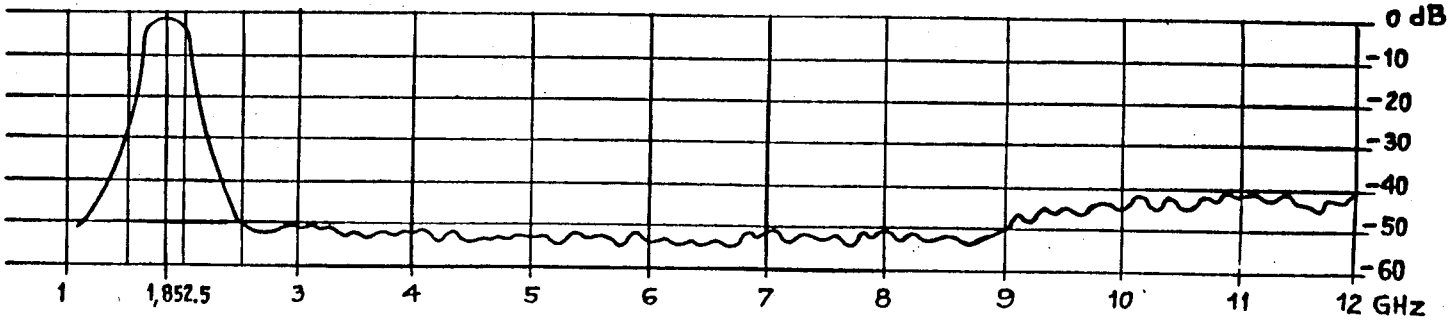
FIG. 6 is an illustration of the response curve of a filter according to the invention, tuned to a central frequency of 1852.5 MHz.

By way of example, FIG. 6 illustrates a transmission curve obtained by means of a band-pass filter centered on the frequency of 1852.5 MHz, from which it is apparent that the filter remains virtually unaffected by interference frequencies up to 12 GHz.

The examples which have been given of preferred embodiments of the invention are not limited to the filters described in the foregoing, and it is evident that it is equally applicable to other modified embodiments able to make use of microcircuit production techniques.

It will equally be understood that the invention is not limited either to the number of resonators utilized, or to the shape of the resonators (which instead of being U-shaped could assume any other shape, V-shaped, linear or other form), or to the kind of capacitors utilized. The capacitors may optionally be tunable, of constant value or formed by interposed capacitors engraved on the substrate.

We claim:

1. A microwave filter, comprising:

a dielectric substance having first and second faces;

a ground plane metallized on said second face; and at least one linear resonator resonant at a resonance frequency $F_o$ having a corresponding resonance wavelength, each said linear resonator including:

a conductor of length L formed on said first face, said conductor having first and second extremities and a center region substantially equidistant between said extremities, said length L being less than one half of said resonance wavelength, said first and second extremities being coupled to said ground plane, said conductor adapted to receive an input microwave signal between said first extremity and said center region, and to provide a filtered microwave signal output between said second extremity and said center region; and at least one capacitor means, each one of said at least one capacitor means having electrodes which are respectively coupled to said ground plane and to said conductor center region, for tuning said linear resonator to its resonance frequency $F_o$.

2. A microwave filter according to claim 1, wherein each said capacitor means has an adjustable capacitance.

3. A microwave filter according to claim 2, wherein said first and second extremities are connected to said ground plane through metallized holes.

4. A microwave filter according to claim 3, wherein each said conductor is formed in a U-shaped configuration and has first and second parallel branches connected together.

5. A microwave filter according to claim 4 further including:

a first coupling conductor formed on said first face substantially parallel to said first and second branches and adapted to feed said input microwave signal to said at least one linear resonator; and a second coupling conductor formed on said first face substantially parallel to said first and second branches and on an opposite side of said first face from said first coupling conductor, adapted for providing said filtered microwave signal output from said at least one linear resonator.

6. A filter according to claim 5, wherein said filter is a band-pass filter.

7. A filter according to claim 6, wherein said at least one linear resonator includes more than one U-shaped conductor, the U-shaped conductors being arranged on said first face so that the branches of all U-shaped conductors are substantially parallel but the extremeties of each U-shaped conductor are pointed in substantially reversed directions with respect to the extremeties of adjacent U-shaped conductors.

8. A microwave filter according to claim 2, wherein said at least one capacitor means includes first and second plates, said first plate being connected to said center region of said conductor, and said second plate being connected to said ground plane.

9. A filter according to claim 4 wherein said at least one resonator includes more than one U-shaped conductor, the U-shaped conductors being arranged on said first face so that the branches of all U-shaped conductors are substantially parallel, and further including a coupling conductor formed on said first face substantially parallel to said U-shaped conductor branches and located between branches of adjacent U-shaped conductors, said coupling conductor adapted to feed said input microwave signal to said adjacent U-shaped conductors so that said filter forms a band cut-off filter.

* * * * *